US011599047B2

(12) United States Patent
Onishi

(10) Patent No.: US 11,599,047 B2
(45) Date of Patent: Mar. 7, 2023

(54) IMAGE FORMING APPARATUS

(71) Applicant: KYOCERA Document Solutions Inc., Osaka (JP)

(72) Inventor: Shota Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/488,754

(22) Filed: Sep. 29, 2021

(65) Prior Publication Data

US 2022/0100132 A1 Mar. 31, 2022

(30) Foreign Application Priority Data

Sep. 30, 2020 (JP) ..... JP2020-165054

(51) Int. Cl.
*G03G 15/20* (2006.01)
*G03G 15/02* (2006.01)

(52) U.S. Cl.
CPC ..... *G03G 15/2053* (2013.01); *G03G 15/0216* (2013.01); *G03G 15/2017* (2013.01)

(58) Field of Classification Search
CPC ..... G03G 15/80; G03G 15/2053; G03G 21/1652; G03G 15/5004
See application file for complete search history.

(56) References Cited

U.S. PATENT DOCUMENTS 9,841,709 B2 12/2017 Nakano
2015/0216036 A1* 7/2015 Serizawa ..... H05K 1/117 174/250
2016/0187864 A1* 6/2016 Choe ..... G05B 19/048 700/291
2016/0306315 A1* 10/2016 Uehara ..... G03G 15/6561
2017/0299989 A1 10/2017 Nakano
2018/0103542 A1* 4/2018 Shinotsuka ..... G03G 21/1652

FOREIGN PATENT DOCUMENTS

JP 2017-194499 A 10/2017
JP 2017-219790 A 12/2017
JP 2018-004670 A 1/2018
JP 2018-010163 A 1/2018

* cited by examiner

*Primary Examiner* — Jessica L Eley
(74) *Attorney, Agent, or Firm* — Studebaker & Brackett PC

(57) ABSTRACT

An image forming apparatus includes an image forming device, a fixing device, a high voltage power supply board, a main body housing and a door. The door is provided in the main body housing so as to face the fixing device. The fixing device includes a fixing member, a pressure roller, a charge applying device, a fixing housing and a contact member. The fixing member is rotatable. The charge applying device is applied with a voltage from the high voltage power supply board and applies a charge to the fixing member. The fixing housing stores the fixing member, the pressure roller and the charge applying device. The contact member is provided in the fixing housing at a position accessible by opening the door and to which a feed line on the high voltage power supply board side and a feed line on the charge applying device side are connected.

4 Claims, 11 Drawing Sheets

IMAGE FORMING APPARATUS

INCORPORATION BY REFERENCE

This application is based on and claims the benefit of priority from Japanese patent application No. 2020-165054 filed on Sep. 30, 2020, which is incorporated by reference in its entirety.

BACKGROUND

The present disclosure relates to an image forming apparatus including a fixing device.

An electrophotographic image forming apparatus is provided with a fixing device which fixes a toner on a sheet. The fixing device includes a cylindrical fixing member (a belt or a roller), a pressure roller which holds the sheet between the fixing member and the pressure roller, and a heater which heats the fixing member. In the fixing device, there is a case where an electrostatic offset occurs in which the toner is transferred from the sheet to the fixing member due to frictional charging or peeling charging of the fixing member. Therefore, in order to suppress the electrostatic offset, a charge applying device which applies a charge having a polarity opposite to that of the charge is provided. The charge applying device removes electricity from the fixing member by corona discharging from a needle-like electrode facing the fixing member.

By the way, the product is inspected after the completion of assembly at the factory. At this time, a voltage from the high voltage power supply board to the charge applying device is also checked. However, since the charge applying device is provided inside the fixing device, it is conventionally necessary to detach the fixing device from the image forming apparatus in order to directly check the output. As a means for checking the output without detaching the fixing device, it is considered to form an image by using image data prepared so as to generate the electrostatic offset when the electric charge is not normally applied, and to check that the electrostatic offset does not occur thereby to indirectly check the output. However, the fixing process needs to be continued for a long time before the electrostatic offset occurs, which is inefficient.

SUMMARY

In accordance with an aspect of the present disclosure, an image forming apparatus includes an image forming device, a fixing device, a high voltage power supply board, a main body housing and a door. The image forming device forms a toner image on a sheet. The fixing device fixes the toner image on the sheet. The main body housing stores the image forming device, the fixing device and the high voltage power supply board. The door is provided in the main body housing so as to face the fixing device. The fixing device includes a fixing member, a pressure roller, a charge applying device, a fixing housing and a contact member. The fixing member is rotatable. The pressure roller holds the sheet between the fixing member and the pressure roller. The charge applying device is applied with a voltage from the high voltage power supply board and applies a charge to the fixing member. The fixing housing stores the fixing member, the pressure roller and the charge applying device. The contact member is provided in the fixing housing at a position accessible by opening the door and to which a feed line on the high voltage power supply board side and a feed line on the charge applying device side are connected.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
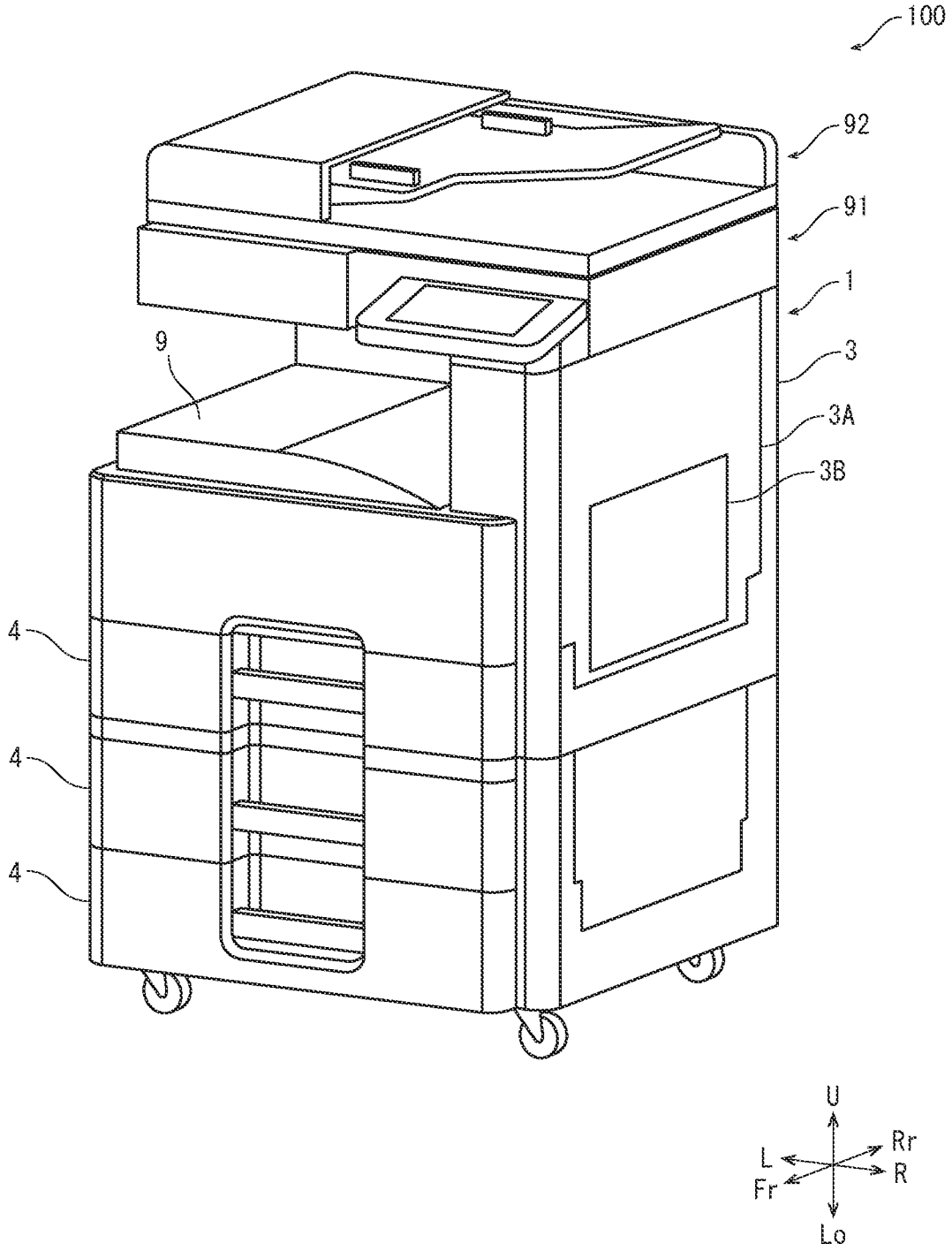
FIG. 1 is a perspective view showing an external appearance (in a state where a door of a main body housing is closed) of a multifunctional peripheral according to one embodiment of the present disclosure.

Hereinafter, with reference the attached drawings, a multifunctional peripheral 100 according to one embodiment of the present disclosure will be described. The multifunctional peripheral 100 includes a printer 1 (an example of an image forming apparatus), an image reading device 91 and a document feeding device 92. The printer 1 includes an image forming device 6 and a fixing device 7.

Figure 2:
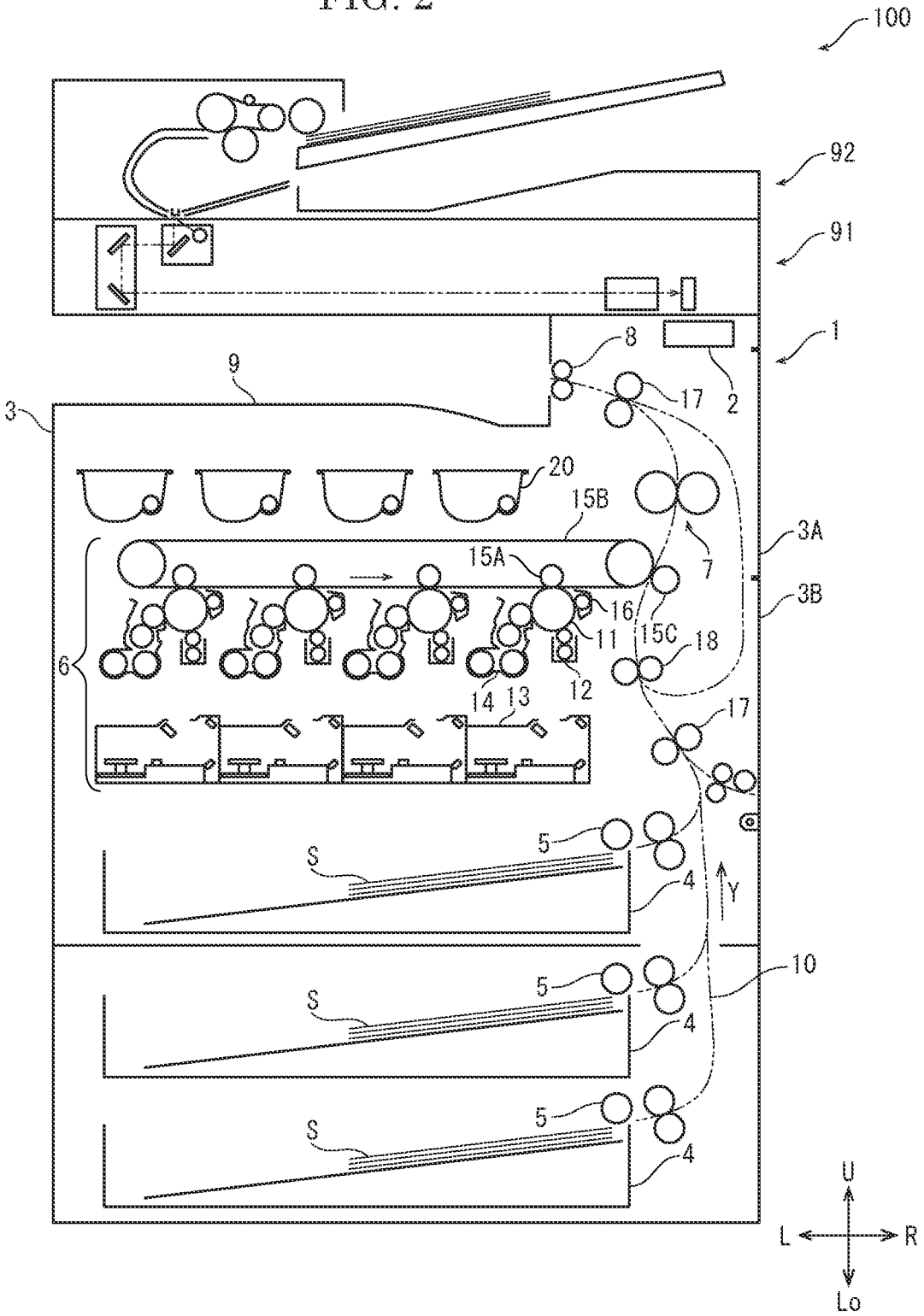
FIG. 2 is a front view schematically showing an inner structure of the multifunctional peripheral according to the embodiment of the present disclosure.

First, an entire structure of the printer 1 will be described. FIG. 1 is a perspective view showing an external appearance of the multifunctional peripheral 100 (in a state where a door 3A of a main body housing 3 is closed). FIG. 2 is a front view schematically showing an inner structure of the multifunctional peripheral 100. Hereinafter, the front side of the paper surface on which FIG. 2 is drawn is defined as a front side of the multifunctional peripheral 100, and the right-and-left direction is described with reference to the direction in which the multifunctional peripheral 100 is viewed from the front side. In each drawing, U, Lo, L, R, Fr and Rr indicate upper, lower, left, right, front and rear, respectively.

The printer 1 includes the rectangular parallelepiped main body housing 3. In the lower portion of the main body housing 3, a sheet feeding cassette 4 in which a sheet S is stored and a sheet feeding roller 5 which feeds the sheet S from the sheet feeding cassette 4 are provided. Above the sheet feeding cassette 4, an image forming device 6 which forms a toner image in an electrophotographic manner and a fixing device 7 which fixes the toner image on the sheet S are provided. In the upper portion of the main body housing 3, a discharge rollers pair 8 which discharges the sheet S on which the toner image is fixed and a discharge tray 9 on which the discharged sheet S is stacked are provided.

The image forming device 6 includes: a photosensitive drum 11 whose potential is changed by irradiation of light; a charging device 12 which charges the photosensitive drum 11 by discharge; an exposure device 13 which emits laser light according to image data; a development device 14 which supplies a toner to the photosensitive drum 11; a transfer roller 15 which generates a transfer bias; and a cleaning device 16 which removes the toner remaining on the photosensitive drum 11. A toner container 20 which supplies the toner to the development device 14 is connected to the development device 14.

Inside the main body housing 3, a conveyance path 10 is provided from the sheet feeding roller 5 to the discharge rollers pair 8 via the image forming device 6 and the fixing device 7. On the conveyance path 10, a plurality of conveyance rollers pairs 17 which convey the sheet S is provided. On the upstream side of the image forming device 6 in the conveyance direction Y, a registration rollers pair 18 is provided.

Each part of the printer 1 is controlled by a controller 2. The controller 2 includes a processor and a memory. The processor is, for example, a CPU (central processing unit). The memory includes a storage medium such as ROM (Read Only Memory), RAM (Random Access Memory), EEPROM (Electrically Erasable Programmable Read Only Memory), etc. The processor executes various processes by reading and executing control program stored in the memory. The controller 2 may be implemented by an integrated circuit that does not use software.

Next, an outline of the image forming operation of the printer 1 will be described. When a printing job is input to the printer 1 from an external computer or the like, the sheet feeding roller 5 feeds the sheet S from the sheet feeding cassette 4 to the conveyance path 10, the registration rollers pair 18 whose rotation is stopped corrects a skew of the sheet S, and the registration rollers pair 18 feeds the sheet S to the image forming device 6 at a predetermined timing. In the image forming device 6, the charging device 12 charges the photosensitive drum 11 to a predetermined potential, the exposure device 13 writes an electrostatic latent image on the photosensitive drum 11, the development device 14 develops the electrostatic latent image using the toner supplied from the toner container 20, and the transfer roller 15 transfers the toner image to the sheet S. Subsequently, the fixing device 7 fuses the toner image while holding and conveying the sheet S to fix the toner image on the sheet S, and the discharge rollers pair 8 discharges the sheet S to the discharge tray 9. The cleaning device 16 removes the toner remaining on the photosensitive drum 11.

Figure 3:
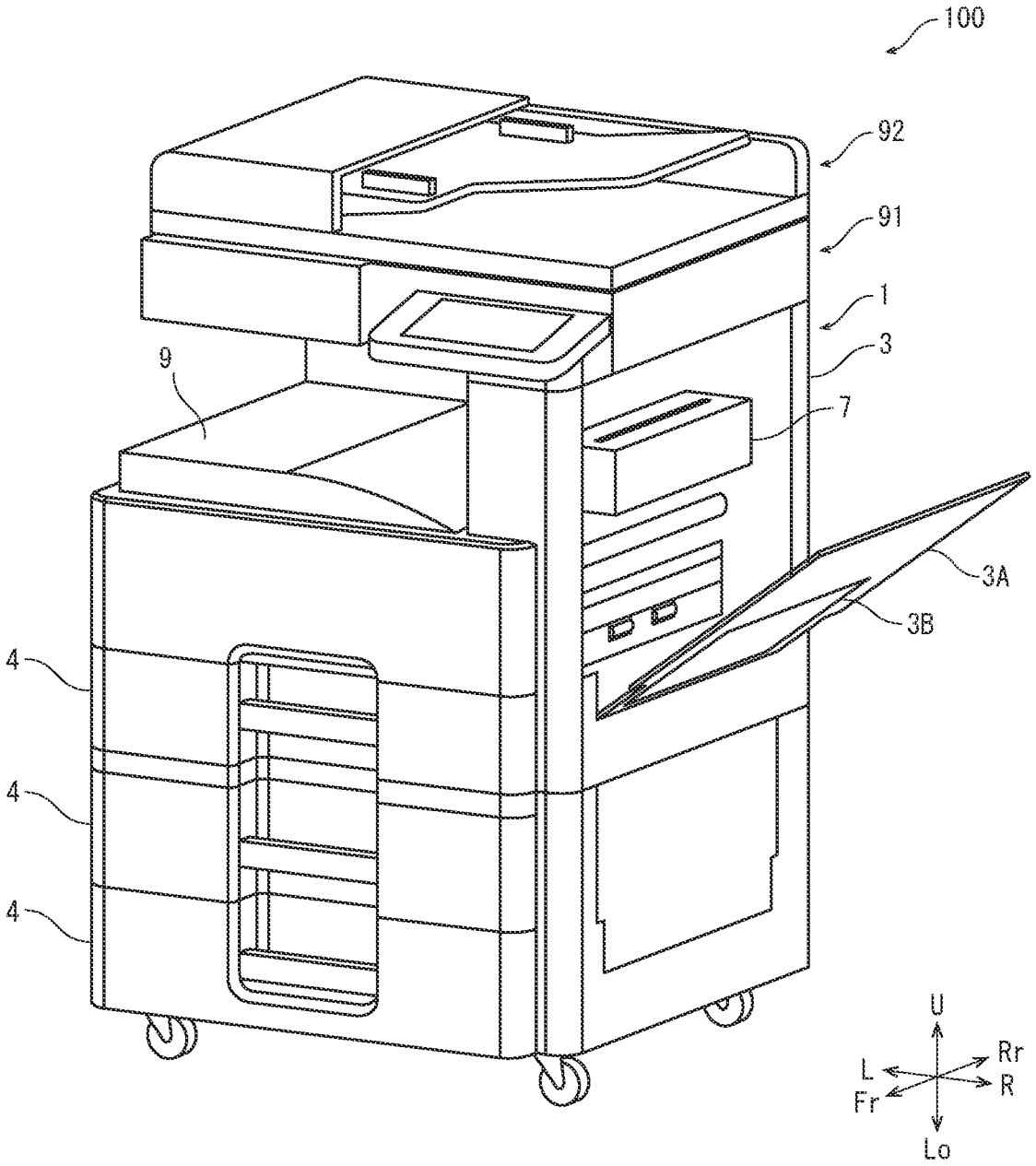
FIG. 3 is a perspective view showing the main body housing in a state where the door is opened, according to the embodiment of the present disclosure.
Figure 4A:
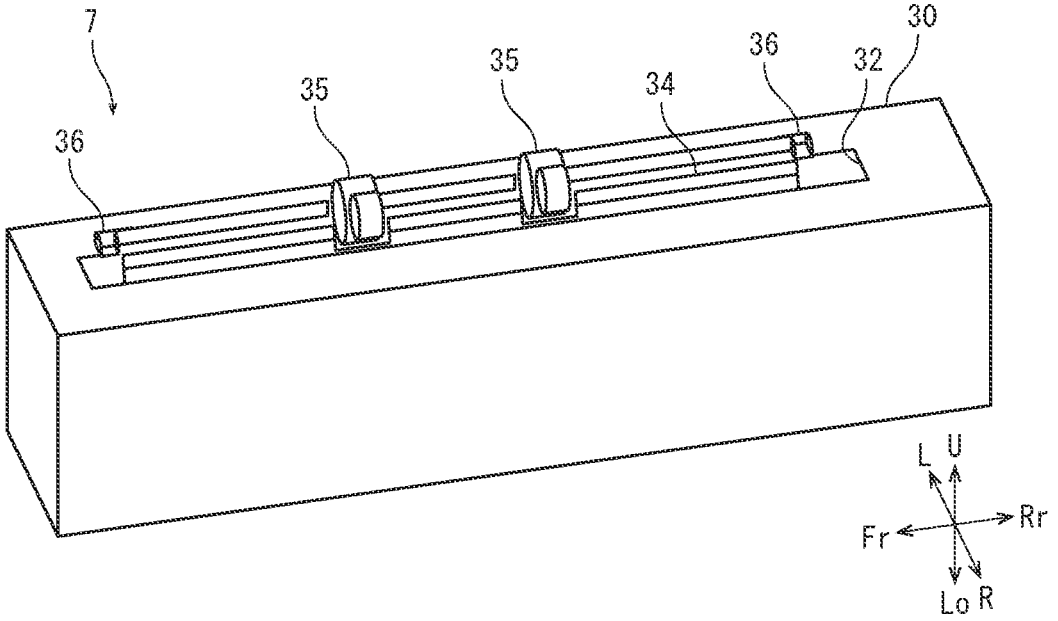
FIG. 4A is a perspective view showing an external appearance of a fixing device according to the embodiment of the present disclosure.
Figure 4B:
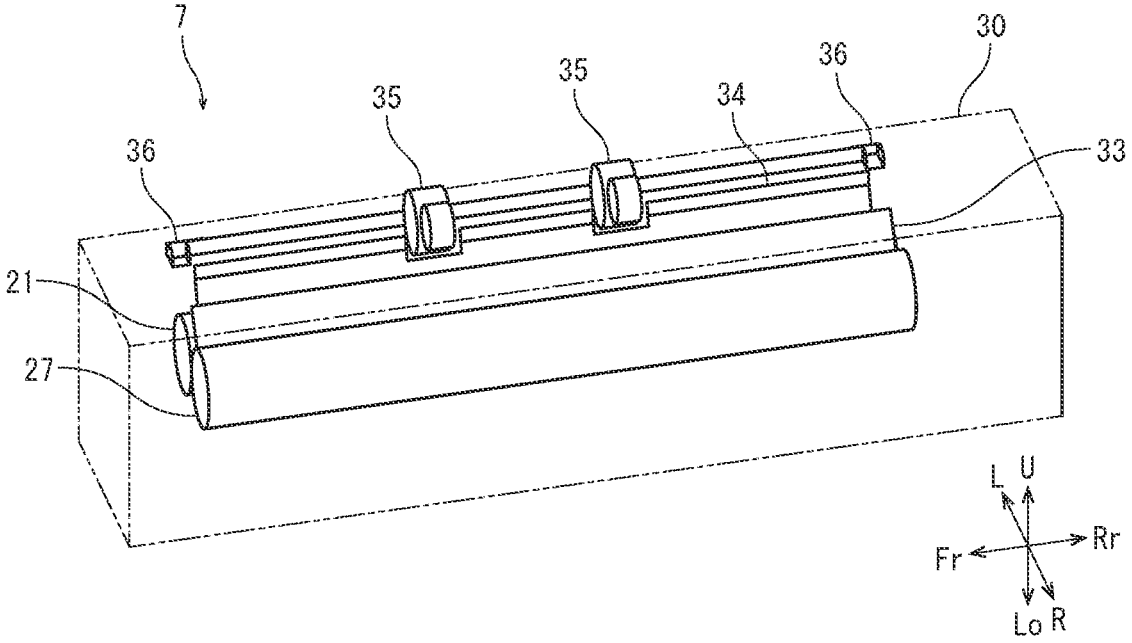
FIG. 4B is a perspective view showing an inner structure of the fixing device according to the embodiment of the present disclosure.
Figure 5:
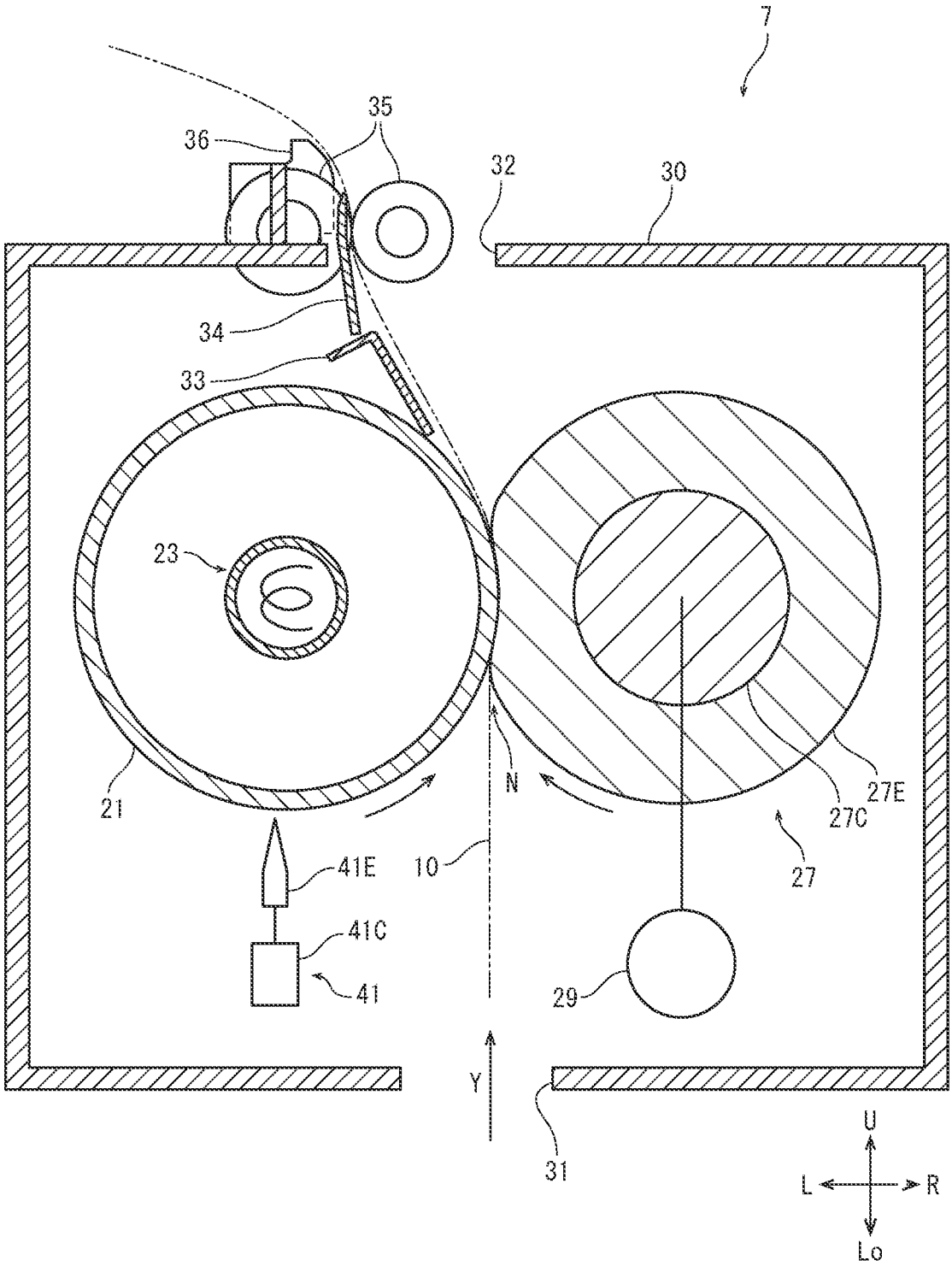
FIG. 5 is a sectional view showing the fixing device according to the embodiment of the present disclosure.
Figure 6:
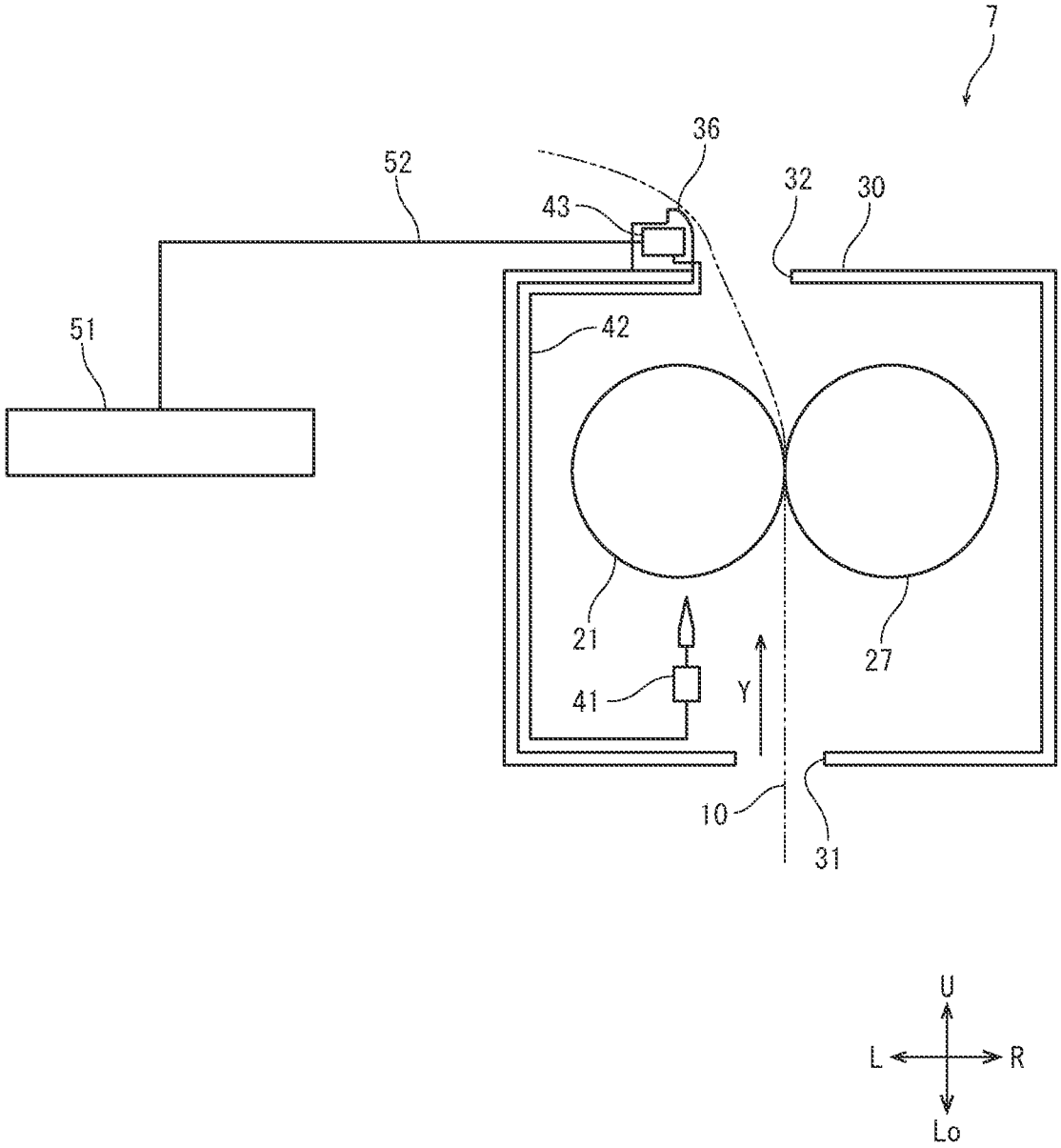
FIG. 6 is a view showing a wiring between a high voltage power supply board and a charge applying device, according to the embodiment of the present disclosure.
Figure 7:
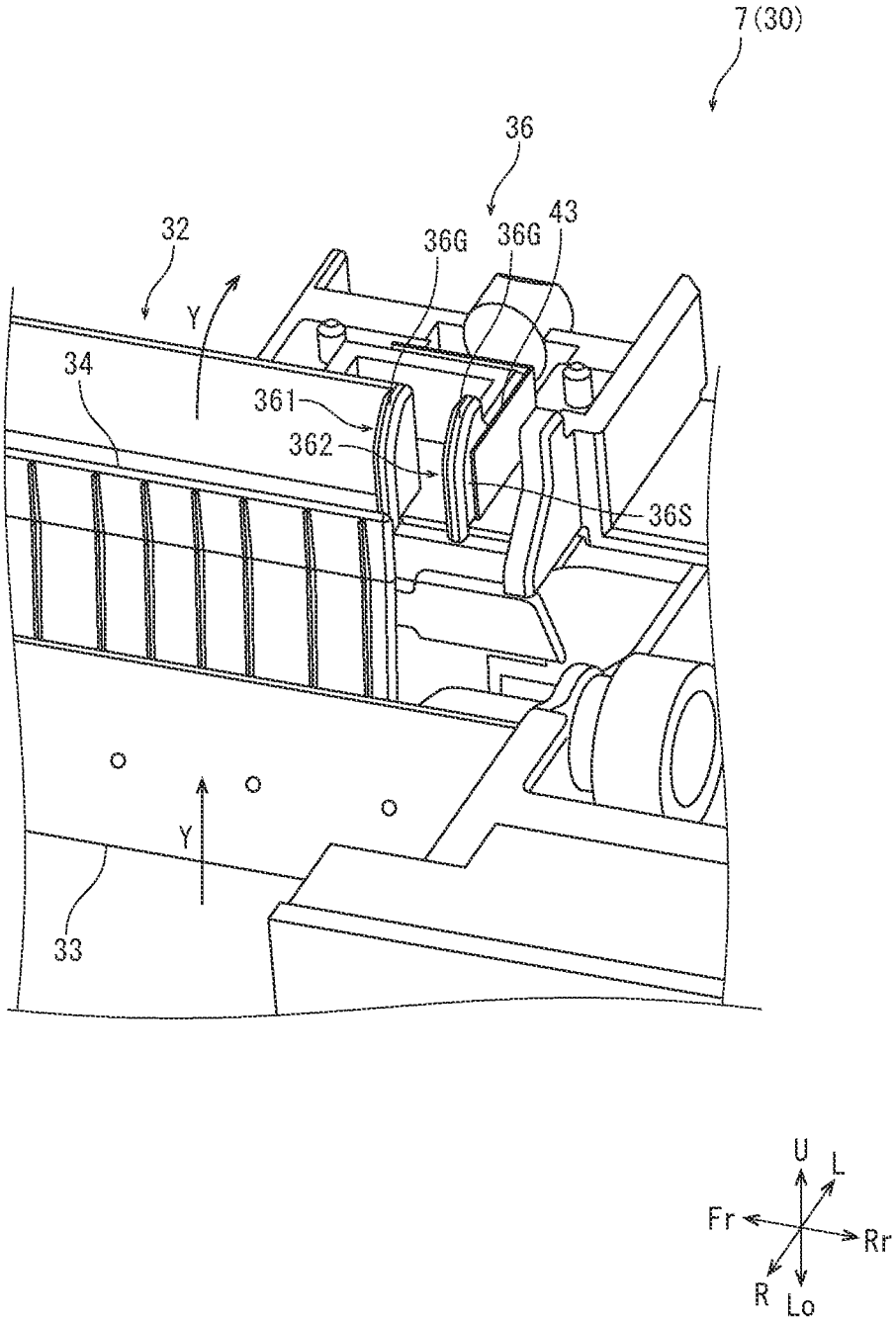
FIG. 7 is a perspective view showing a protruded portion of the fixing device according to the embodiment of the present disclosure.
Figure 8:
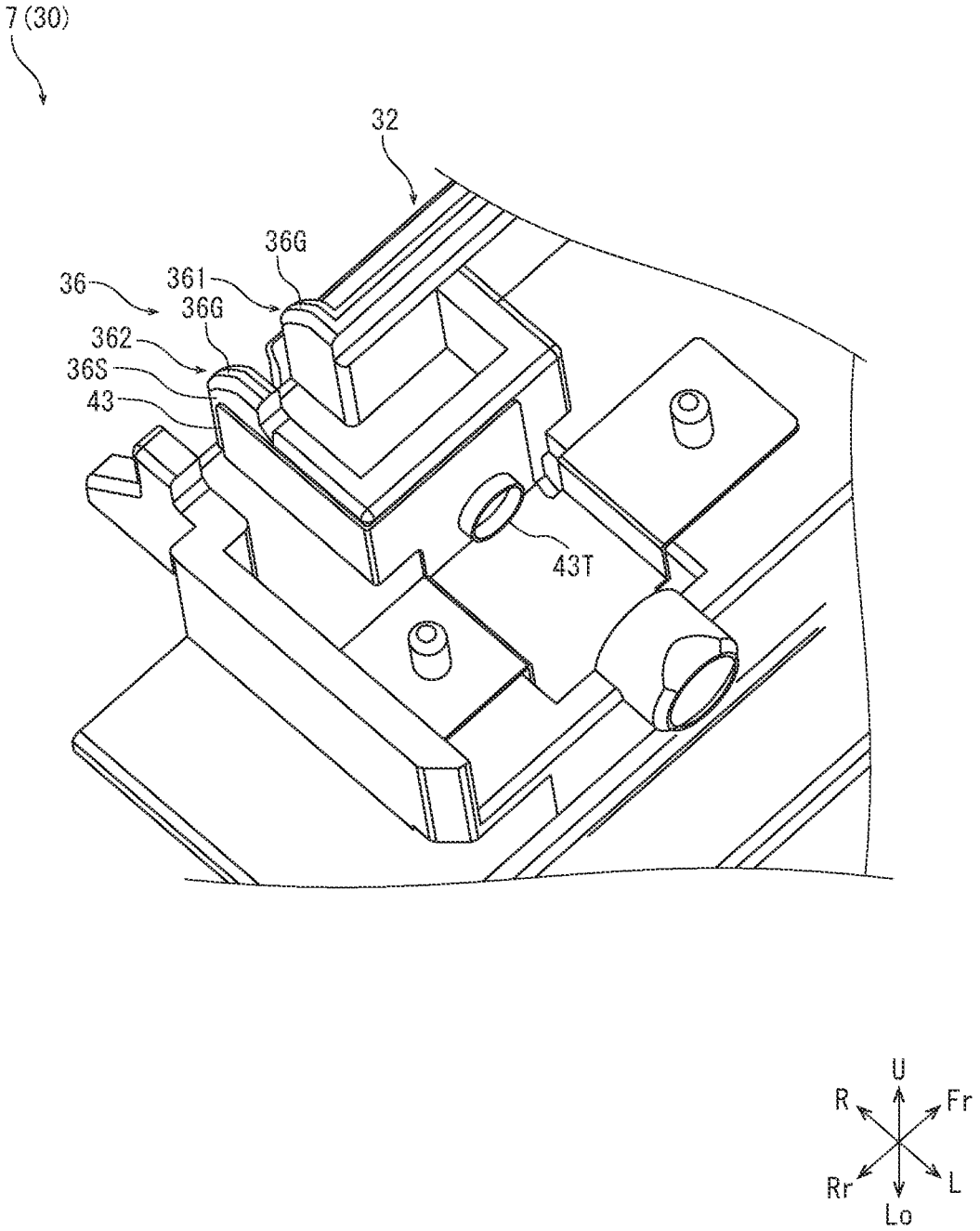
FIG. 8 is a perspective view showing the protruded part of the fixing device according to the embodiment of the present disclosure.
Figure 9:
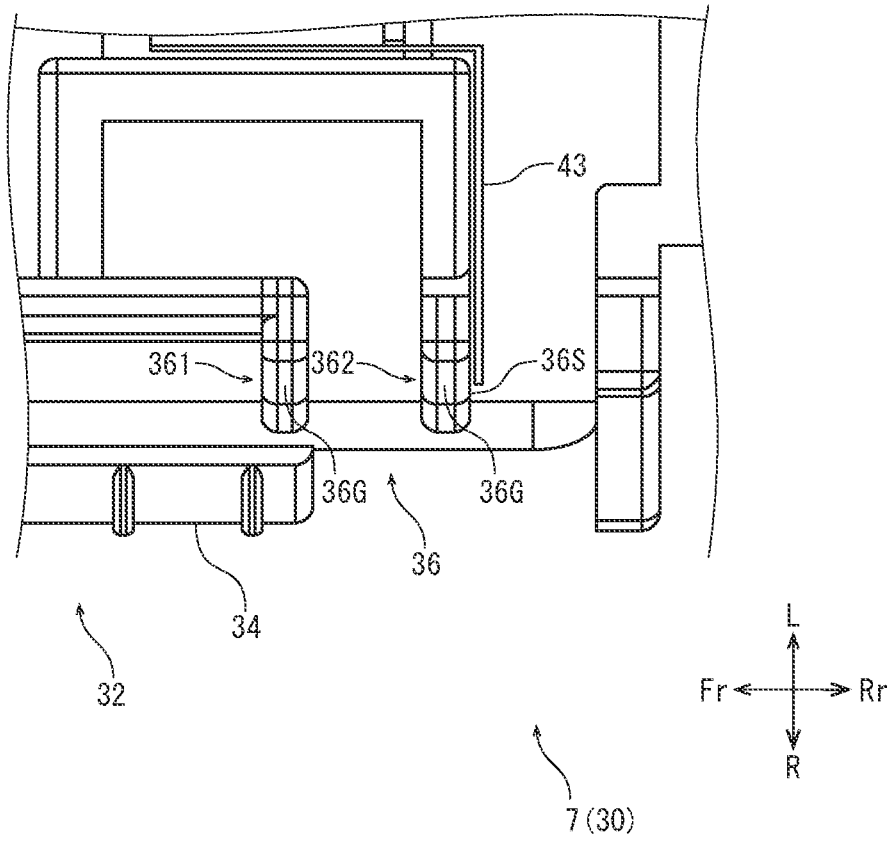
FIG. 9 is a plan view showing the protruded part of the fixing device according to the embodiment of the present disclosure.

<Fixing Device> Next, the structure of the fixing device 7 will be described in detail. FIG. 3 is a perspective view showing the fixing device 7 in a state where a door 3A of the main body housing 3 is opened. FIG. 4A is a perspective view showing an external appearance of the fixing device 7. FIG. 4B is a perspective view showing an inner structure of the fixing device 7. FIG. 5 is a sectional view showing the fixing device 7. FIG. 6 is a view schematically showing a wiring between a high voltage power supply board 51 and a charge applying device 41. FIG. 7 and FIG. 8 are perspective views showing a protruded part 36 of the fixing device 7. FIG. 9 is a plan view showing the protruded part 36 of the fixing device 7.

The printer 1 is provided with: the image forming device 6 which forms the toner image on the sheet S; the fixing device 7 which fixes the toner image on the sheet S; the high voltage power supply board 51; the main body housing 3 which stores the image forming device 6, the fixing device 7, and the high voltage power supply board 51; and the door 3A which is provided in the main body housing 3 so as to face the fixing device 7. The fiving device is provided with; a rotatable fixing member 21; a pressure roller 27 which holds the sheet S between the fixing member 21 and the pressure roller 27; the charge applying device 41 which is applied with a voltage from the high voltage power supply board 51 and applied a charge to the fixing member 21; a fixing housing 30 which houses the fixing member 21, the pressure roller 27 and the charge applying device 41; a contact member 43 provided at a position accessible by opening the door 3A and to which a feed line 52 on the high voltage power supply board 51 side and a feeder line 42 on the charge applying device 41 side are connected. The details are as follows.

[Main Body housing and door] As shown in FIG. 2 and FIG. 3, the door 3A is provided on the right side surface of the main body housing 3 in an openable and closable manner around a hinge provided at the lower end portion. The lower portion of the door 3A serves also as a manual sheet feeding tray 3B, and can be opened and closed around a hinge provided at the lower end portion in a state where the door 3A is closed. The door 3A is opened when the sheet S jammed on the conveyance path 10 is removed or the fixing device 7 is repaired. The fixing device 7 is disposed at a position facing the inner surface of the door 3A, and when the door 3A is opened, the right side portion and the upper portion of the fixing device 7 are exposed.

<Fixing Member> The fixing member 21 is a cylindrical roller member whose longitudinal direction is along the front-and-rear direction, and a thin pipe such as an aluminum alloy pipe or a stainless steel pipe is used. A release layer (not shown) made of a fluororesin or the like is provided around the outer circumferential surface of the thin pipe.

<Pressure Roller> The pressure roller 27 has a cylindrical columnar or cylindrical core bar 27C whose longitudinal direction is along the front-and-rear direction, an elastic layer 27E formed around the outer circumferential surface of the core bar 27C, and a release layer (not shown) formed around the outer circumferential surface of the elastic layer 27E. The core bar 27C is made of metal such as an aluminum alloy or stainless steel. The elastic layer 27E is made of silicone rubber or the like. The release layer is made of fluororesin or the like. Bearings (not shown) are attached to both right and left ends of the core bar 27C. The bearings are supported by a mechanism configured to be movable in the upper-and-lower direction (not shown). The pressure roller 27 is biased upward by a biasing member (not shown) such as a spring through the bearings, and is brought into pressure contact with the fixing member 21 to form a pressure area N in which the fixing member 21 and the pressure roller 27 come into surface contact with each other.

A driving part 29 includes a motor and a gear train, and rotates the pressure roller 27. The fixing member 21 rotates following the pressure roller 27.

[Heating Part] A heating part 23 is a rod-like halogen heater whose longitudinal direction is along the front-and-rear direction, includes a glass tube and a filament housed in the glass tube, and is disposed inside the fixing member 21.

[Charge Applying Device] The charge applying device 41 includes an electrode needle 41E and a circuit 41C. The electrode needle 41E has a base whose longitudinal direction is along the front-and-rear direction, and a large number of needle-like projections projecting upward from the base are arranged in the front-and-rear direction. When a voltage of several 1000 V is applied from the circuit 41C to the electrode needle 41E, corona discharge is generated at the tip of the electrode needle 41E.

<Fixing Housing> The fixing housing 30 is a box having a rectangular parallelepiped shape as a whole whose longitudinal direction is along the front-and-rear direction, and the fixing member 21, the pressure roller 27, and the charge applying device 41 are housed in the fixing housing 30. A bottom plate of the fixing housing 30 is provided with an inlet 31 of the sheet S. A top plate of the fixing housing 30 is provided with an outlet 32 of the sheet S. On the downstream side of the pressure area N in the conveyance direction Y, a blade 33 is provided. When the tip of the blade 33 comes into contact with the fixing member 21, the sheet S adhering to the fixing member 21 is peeled off from the fixing member 21. On the downstream side of the blade 33 in the conveyance direction Y, a guide plate 34 for guiding the sheet S upward is provided. The upper portion of the guide plate 34 is exposed to the outside through the outlet 32. Two notches are formed in the upper portion of the guide plate 34, and a pair of conveyance rollers 35 facing each other in the left-and-right direction is provided through the notches.

As shown in FIG. 4A and FIG. 4B, the fixing housing 30 includes a protruded part 36 provided at the longitudinal end portions of the outlet 32 of the sheet S along the conveyance direction Y. More specifically, as shown in FIG. 5, the conveyance path 10 extends from the inlet 31 through the pressure area N, the blade 33, the guide plate 34, and the outlet 32 toward the discharge rollers pair 8 in the upper left direction. At the end portions of the outlet 32 in the front-and-rear direction (the longitudinal direction), the protruded parts 36 having a plate-like shape protruding to the image formed surface of the conveyed sheet S are formed. Although the rear protruded part 36 is shown in FIG. 7 to FIG. 9, the front protruded part 36 has the same shape as the rear protrude part 36 except that the front-and-rear direction is inverted. The protruded part 36 includes a first protruded piece 361 with which the maximum size sheet S comes into contact, and a second protruded piece 362 which is provided outside the first protruded piece 361 with a distance from the first protruded piece 361 and with which the maximum size sheet S comes into contact only when the sheet S is conveyed in an inclined posture. Each of the first protruded piece 361 and the second protruded piece 362 is provided with a guide surface 36G smoothly curved from the outlet 32 toward the upper left side, and the sheet S is guided in the conveyance direction Y by the guide surface 36G coming into contact with the image formed surface of the sheet S.

[Contact Member] The contact member 43 is provided on the surface of the second protruded piece 362 where the sheet S does not face. As shown in FIG. 7 to FIG. 9, the contact member 43 is provided so as to turn from the left side of the second protruded piece 362 to the rear side surface 36S. As shown in FIG. 6, to the contact member 43, the feed line 52 on the high voltage power supply board 51 side and the feed line 42 on the charge applying device 41 side are connected. The feed line 42 is wired to the charge applying device 41 via the outlet 32 and the inner surface of the fixing housing 30. The contact member 43 includes a terminal 43T to which the feed line 52 is connected (see FIG. 8).

Figure 10:
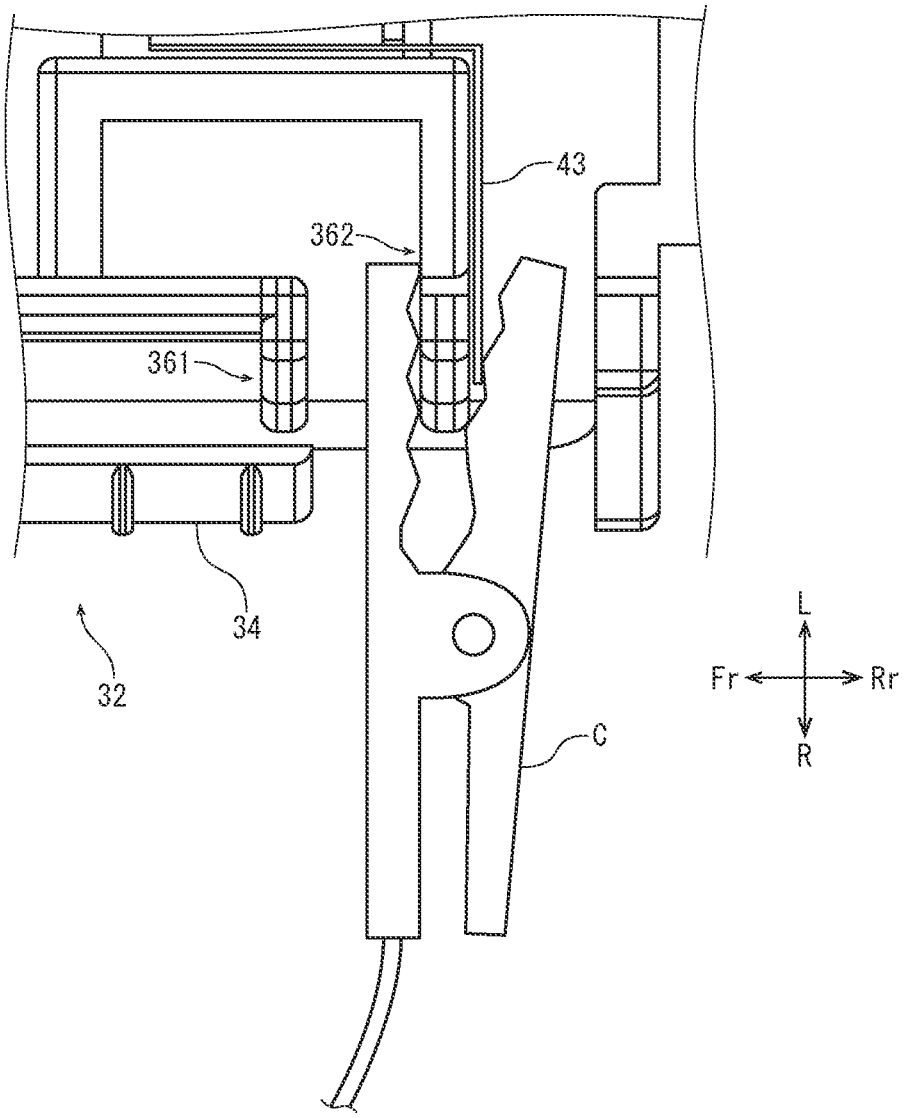
FIG. 10 is a plan view showing a state where an output of a voltage from the high voltage power supply board to the charge applying device is checked, according to the embodiment of the present disclosure.

FIG. 10 is a plan view showing a state where the output of the voltage from the high voltage power supply board 51 to the charge applying device 41 is checked. The output check is performed by opening the door 3A after the assembly of the multifunction peripheral 100 is completed (see FIG. 3). When the operator opens the door 3A, the upper surface and the right side surface of the fixing device 7 are exposed, and the protruded part 36 can be accessed. When the operator mounts an alligator clip C on the second protruded piece 362, the alligator clip C comes into contact with the contact member 43. The alligator clip C is connected to a circuit meter (not shown). The operator turns on power to the printer 1 and inputs an image forming job for testing. When a voltage of a predetermined value is outputted from the high voltage power supply board 51 to the charge applying device 41, the predetermined value is displayed on the circuit meter.

According to the printer 1 according to the embodiment described above, since the contact member 43 is provided at a position accessible by opening the door 3A and is connected to the feed line 52 on the high voltage power supply board 51 side and the feed line 42 on the charge applying device 41 side, the output of the voltage to the charge applying device 41 can be checked directly without detaching the fixing device 7 from the printer 1.

Further, according to the printer 1 according to the present embodiment, the fixing housing 30 is provided with the protruded parts 36 provided at the longitudinal end portions of the outlet 32 of the sheet S along the conveyance direction Y, and the contact member 43 is provided at the protruded part 36, so that the output can be checked by gripping the protruded part 36 with the alligator clip C, thereby facilitating the work.

Further, according to the printer 1 according to the present embodiment, since the contact member 43 is provided on the surface of the protruded part 36 where the sheet S does not face, damage to the contact member 43 can be prevented. Further, the contact member 43 does not apply a resistance to the conveying of the sheet S.

Further, according to the printer 1 of the present embodiment, the protruded part 36 is provided with the first protruded piece 361 with which the maximum size sheet S comes into contact, and the second protruded piece 362 which is provided on the outside of the first protruded piece 361 at a distance from the first protruded piece 361 and with which the maximum size sheet S comes into contact only when the sheet S is conveyed in an inclined posture, and the contact member 43 is provided in the second protruded piece 362. Conventionally, since the first protruded piece 361 and the second protruded piece 362 are formed as one continuous protruded part 36, they are difficult to be gripped with the alligator clip C. Further, even if it is gripped with the alligator grip C, because the opening angle of the alligator clip C becomes large, it is difficult for the alligator clip C to come into contact with the contact member 43. On the other hand, in the present embodiment, because the second protruded piece 362 is formed at a distance from the first protruded piece 361 and the thickness of the second protruded piece 362 is smaller than that of the conventional protruded part 36, it is easily gripped with the alligator clip C, and the alligator clip C is easily brought into contact with the contact member 43. In addition, since the protruded part 36 has a shape in which the conventional protruded part 36 is divided into two parts, design change is reduced.

The above embodiment may be modified as follows.

In the above embodiment, the protruded part 36 includes the first protruded piece 361 and the second protruded piece 362, but the protruded part 36 may not include the second protruded piece 362, and the contact member 43 may be provided on the first protruded piece 361.

Figure 11:
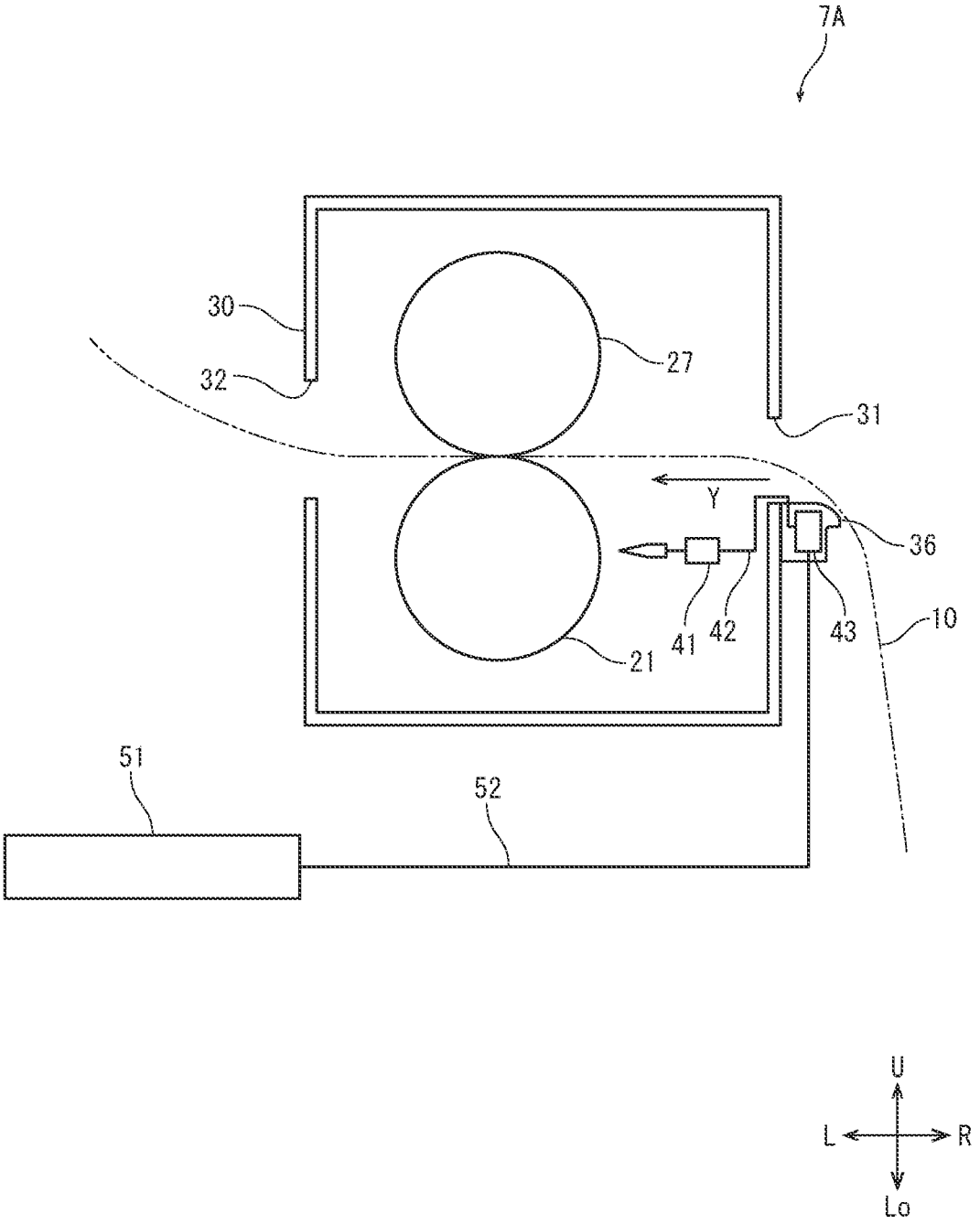
FIG. 11 is a sectional view showing the fixing device according to a modified example of the embodiment of the present disclosure.

In the above embodiment, the contact member 43 is provided on the protruded part 36 provided at the longitudinal end portion of the outlet 32 of the sheet S along the conveyance direction Y of the sheet S, but the contact member 43 may be provided on the protruded part 36 provided at other positions. FIG. 11 is a sectional view showing the fixing device 7A according to the present modified example. In this example, the inlet 31 of the sheet S of the fixing device 7A is provided on the right side, and the outlet 32 is provided on the left side. In this case, since the portion accessible by opening the door 3A is in the vicinity of the inlet 31, the protruded part 36 is provided at the longitudinal end portion of the inlet 31. With this configuration, the same effects as those of the above-described embodiment can be obtained.

Alternatively, when there is a protruded portion accessible by opening the door 3A other than the outlet 32 and the inlet 31 of the sheet S, the contact member 43 may be provided at the protruded portion.

In addition to the configuration of the above embodiments, a cover may be provided to cover the contact member 43 after the output check. According to this configuration, it is possible to prevent a user from accidentally touching the contact member 43.

Although one aspect of the embodiment according to the present disclosure is described, the present disclosure is not limited to the above embodiment. The present disclosure may be modified, substituted, or modified in various ways without departing from the spirit of the technical idea.

The invention claimed is:

1. An image forming apparatus comprising:

an image forming device which forms a toner image on a sheet;

a fixing device which fixes the toner image on the sheet;

a high voltage power supply board;

a main body housing in which the image forming device, the fixing device and the high voltage power supply board are stored; and a door provided in the main body housing so as to face the fixing device, wherein the fixing device includes:

a rotatable fixing member;

a pressure roller which holds the sheet between the fixing member and the pressure roller;

a charge applying device which is applied with a voltage from the high voltage power supply board and applies a charge to the fixing member;

a fixing housing in which the fixing member, the pressure roller and the charge applying device are stored; and a contact member provided in the fixing housing at a position accessible by opening the door and to which a feed line on the high voltage power supply board side and a feed line on the charge applying device side are connected, the fixing housing has a protruded part provided in a longitudinal end portion of an inlet or an outlet of the sheet along a conveyance direction of the sheet, the protruded part has:

a first protruded piece with which the maximum size sheet comes into contact; and a second protruded piece which is provided outside the first protruded piece with a distance from the first protruded piece and with which the maximum size sheet comes into contact only when the maximum size sheet is conveyed in an inclined posture, and the contact member is provided on the second protruded piece.

2. The image forming apparatus according to claim 1, wherein the contact member is provided on a surface of the protruded part where the sheet does not face.

3. The image forming apparatus according to claim 1, wherein the contact member has a plate-like shape, and is mounted on an outer surface of the second protruded piece.

4. The image forming apparatus according to claim 1, wherein each of the first protruded piece and the second protruded piece has a guide surface along which the sheet is guided.

* * * * *